United States Patent [19]

Kubo et al.

[11] 4,444,844

[45] Apr. 24, 1984

[54] THERMOSENSITIVE RECORDING MATERIAL

[75] Inventors: Keishi Kubo, Yokohama; Masayuki Shoshi, Numazu, both of Japan

[73] Assignee: Ricoh Co., Ltd., Tokyo, Japan

[21] Appl. No.: 385,246

[22] Filed: Jun. 4, 1982

[30] Foreign Application Priority Data

Jun. 10, 1981 [JP] Japan ..... 56-88117

[51] Int. Cl.[3] ..... B41M 5/18

[52] U.S. Cl. ..... 346/208; 428/913; 346/209; 346/216

[58] Field of Search ..... 282/27.5; 427/150, 151; 428/411, 488, 537, 913, 914, 320.4–320.8

[56] References Cited

U.S. PATENT DOCUMENTS 3,539,375 11/1970 Baum ..... 428/537 X

*Primary Examiner*—Bruce H. Hess

*Attorney, Agent, or Firm*—Flynn, Thiel, Boutell & Tanis

[57] ABSTRACT

A thermosensitive recording material which comprises employing a colorless or light-colored leuco-dye, a binder, a specified developer and a specified thermosensitivity promoter as principal components and incorporating them in a thermosensitive color forming layer.

3 Claims, No Drawings

THERMOSENSITIVE RECORDING MATERIAL

BACKGROUND OF THE INVENTION (a) Field of the invention

The present invention relates to a thermosensitive recording material, in particular relates to a thermosensitive recording material improved so as to attain a high density developed color image by employing a colorless or light-colored leuco-dye and a specified compound (developer) as color forming components and further adding a specified thermosensitivity promoter thereto.

(b) Description of the prior art

The conventional thermosensitive recording material normally comprises forming the so-called thermosensitive color forming layer devised so as to form color when heated on the surface of a substrate such as paper, plastic sheet, synthetic paper or the like, wherein a thermal printer housing a thermal head therein or the like is utilized for heating purposes. The thermosensitive recording process using such a recording material has hitherto been utilized for the output recording purposes in electronic calculators, facsimile, measuring machines and the like, to say nothing of having been utilized for the reproduction purpose of books, documents and the like. In particular, the recording material, prepared by forming a thermosensitive color forming layer containing a colorless or light-colored leuco-dye with a lactone, lactam or spiropyran ring and an acidic substance (for instance, an organic acid or a phenolic substance) as thermosensitive color forming components on a substrate, has been publicly utilized because it produces a clear-cut color tone.

However, lately there have been increasing requirements for high speed and high density in said output machines, and the fact is that the thermosensitive recording material utilizing the above mentioned color forming components can not fulfil such requirements.

To cope with such requirements, there have usually been made various attempts to promote the thermosensitivity in thermosensitive recording and to achieve high speed in recording by incorporating thermosensitive promoters such as stearic acid amide, linolic acid amide, lauric acid amide, myristic acid amide, hardened beef fatty acid amide, palmitic acid amide, oleic acid amide, rice sugar fatty acid amide, coconut fatty acid amide, or methylol compounds of these fatty acid amides, and fatty acid amide type compounds such as methylenebisstearic acid amide, ethylenebisstearic acid amide and the like in the thermosensitive color forming layer. However, such thermosensitive recording materials can not meet the requirement for thermosensitivity satisfactorily and are noted defective in that the use of said thermosensitive promoters in large quantities causes attachment of dregs to the thermal head during long-run recording, resulting in a sticking phenomenon which acts to retard the sliding speed of the head and deteriorate the clearness of the developed color image heavily, whereby it becomes necessary to clean the thermal head so often in order to remove such trouble.

SUMMARY OF THE INVENTION

It is an object of the present invention to eliminate the shortcomings inherent in the conventional recording materials, in particular to provide a thermosensitive recording material which is entirely freed from the trouble such as deterioration in clearness of the developed color image, attachment of dregs, occurrence of sticking phenomenon to retard the sliding speed of the head and the like.

In order to achieve the above object, our inventors have carried out a series of studies and investigations to discover that the aforesaid problems included in the conventional thermosensitive recordingg materials can be dissolved at once by employing a colorless or light-colored leuco-dye and a specified compound (developer) as thermosensitive color forming components, and further adding another specified compound (thermosensitivity promoter) thereto. The present invention has been completed on the basis of the above discovery.

In other words, the present invention is concerned with a thermosensitive recording material which comprises a thermosensitive color forming layer consisting essentially of a colorless or light-colored leuco-dye, a developer and a thermosensitivity promoter in conjunction with a binder, wherein as said developer there is used at least a member selected from the grup consisting of compounds having the following general formulas:

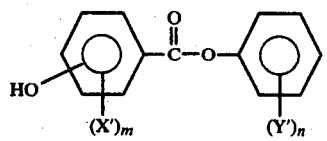

(A-1)

(wherein X' represents halogen, nitro or hydrogen, Y' represents hydrogen, lower alkyl, lower alkoxy, halogen, hydroxyl, benzyl, benzoyl, carboxyl, phenoxy, acetyl or nitro, and m and n each is an integer such as 0, 1, 2 or 3),

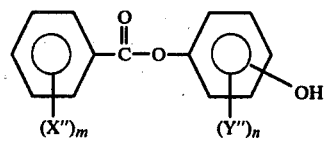

(A-2)

(wherein X'' represents hydrogen, nitro or hydroxyl, Y'' represents hydrogen, lower alkyl, lower alkoxy, halogen, nitro or hydroxyl, and m and n each is an integer such as 0, 1, 2 or 3.), and

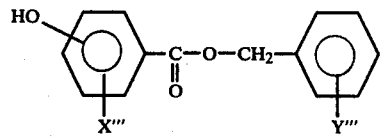

(A-3)

(wherein X''' represents hydrogen, methyl, nitro or halogen, Y''' represents hydrogen, methyl, nitro, hydroxyl or halogen.), and as said thermosensitivity promoter there is used at least a member selected from the group consisting of compounds having the following general formulas:

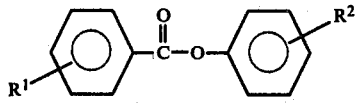

(B-1)

(wherein $R^1$ represents hydrogen, alkyl, alkoxy, halogen, nitro, nitrile, acetoxy, substituted or unsubstituted benzoyloxy, substituted or unsubstituted benzoxy, substituted or unsubstituted aralkyl or substituted or unsubstituted aralkyloxy, and $R^2$ represents hydrogen, alkoxy, halogen, nitro, nitrile, acetoxy, substituted or unsubstituted benzoyloxy, substituted or unsubstituted benzoxy, substituted or unsubstituted aralkyl, substituted or unsubstituted aralkyloxy, formyl, arylketone or aryl.), and

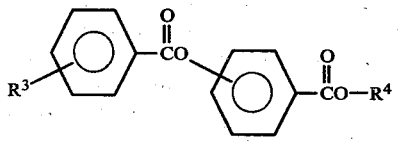

(B-2)

(wherein $R^3$ represents hydrogen, alkyl, alkoxy or halogen, and $R^4$ represents alkyl, substituted or unsubstituted aralkyl, or substituted or unsubstituted phenyl.)

DETAILED DESCRIPTION OF THE PREFERRED EMBODIMENTS

Explaining the present invention in more detail, it may be said that the thermosensitive recording material according to the present invention has improved the shortcomings inherent in the conventional recording materials remarkably by incorporating at least a compound selected from each of Group A (developers) and Group B (thermosensitive promoters) having the aforesaid general formulas together with a leuco-dye in the thermosensitive color forming layer.

In the concrete, the compounds represented by the general formulas belonging to Group (A) are enumerated hereinafter: The following are enumerated as the typical compounds having the general formula (A-1):

4-hydroxybenzoic acid phenylester,
4-hydroxybenzoic acid(2-methoxyphenyl)ester,
4-hydroxybenzoic acid(2-methoxy-4-methylphenyl)ester,
4-hydroxybenzoic acid(2-carboxyphenyl)ester,
4-hydroxybenzoic acid (4-butylphenyl)ester,
3-hydroxybenzoic acid(4-carboxyphenyl)ester,
salicylic acid(2-chlorophenyl)ester,
salicylic acid(4-chlorophenyl)ester,
salicylic acid(2,4-dichlorophenyl)ester,
salicylic acid(2,6-dichlorophenyl)ester,
salicylic acid(2,4,6-trichlorophenyl)ester,
salicylic acid(2-bromophenyl)ester,
salicylic acid(4-bromophenyl)ester,
salicylic acid(2,4-dibromophenyl)ester,
salicylic acid(2,6-dibromophenyl)ester,
salicylic acid(2,4,6-tribromophenyl)ester,
salicylic acid(3-methylphenyl)ester,
salicylic acid(4-tert-butylphenyl)ester,
salicylic acid(4-tert-amylphenyl)ester,
salicylic acid(2-methoxyphenyl)ester,
salicylic acid(3-methoxyphenyl)ester,
salicylic acid(4-hydroxyphenyl)ester,
salicylic acid(4-benzylphenyl)ester,
salicylic acid(4-benzoylphenyl)ester,
salicylic acid(2-carboxyphenyl)ester,
salicylic acid(4-acetylphenyl)ester,
salicylic acid(4-phenoxyphenyl)ester,
salicylic acid(3-hydroxyphenyl)ester,
salicylic acid(4-chloro-3-methylphenyl)ester,
salicylic acid(2-methoxy-4-allylphenyl)ester,
5-chlorosalicylic acid phenylester,
3,5-dichlorosalicylic acid phenylester,
5-bromosalicylic acid(3-nitrophenyl)ester,
5-bromosalicylic acid(4-nitrophenyl)ester,
5-bromosalicylic acid(metatoluyl)ester,
5-bromosalicylic acid(paratoluyl)ester,
5-bromosalicylic acid(orthotoluyl)ester,
3,5-dibromosalicylic acid phenylester,
3,5-dibromosalicylic acid(orthotoluyl)ester,
3,5-dibromosalicylic acid(metatoluyl)ester, and
3,5-dibromosalicylic acid(paratoluyl)ester.

The following are enumerated as the typical compounds having the general formula (A-2):

benzoic acid(2-hydroxyphenyl)ester,
benzoic acid(3-hydroxyphenyl)ester,
benzoic acid(3-nitro-2-hydroxyphenyl)ester,
benzoic acid(6-nitro-3-hydroxyphenyl)ester,
benzoic acid(4-bromo-3-hydroxyphenyl)ester,
benzoic acid(4,6-dibromo-3-hydroxyphenyl)ester,
benzoic acid(2,4,6-tribromo-3-hydroxyphenyl)ester,
benzoic acid(2-methyl-6-hydroxyphenyl)ester,
benzoic acid(3-methyl-4-hydroxyphenyl)ester,
benzoic acid(4-methyl-2-hydroxyphenyl)ester,
benzoic acid(3,4-dimethyl-5-hydroxyphenyl)ester,
benzoic acid(2,3-dimethyl-4-hydroxyphenyl)ester,
benzoic acid(2,4-dimethyl-6-hydroxyphenyl)ester,
benzoic acid(2,5-dimethyl-4-hydroxyphenyl)ester,
benzoic acid(2,3,5-dimethyl-4-hydroxyphenyl)ester,
benzoic acid(2,3-dihydroxyphenyl)ester,
benzoic acid(4-methoxy-2-hydroxyphenyl)ester,
4-nitrobenzoic acid-(2-hydroxyphenyl)ester,
4-nitrobenzoic acid-(3-hydroxyphenyl)ester, and
4-nitrobenzoic acid-(4-hydroxyphenyl)ester.

And, the following are enumerated as the typical compound having the general formula (A-3):

4-hydroxybenzoic acid benzylester,
3-chloro-4-hydroxybenzoic acid benzylester,
salicylic acid-4-nitrobenzylester, and
p-hydroxybenzoic acid-4-nitrobenzylester.

In the concrete, the compounds represented by the general formulas belonging to Group (B) are enumerated hereinafter: The following are enumerated as the typical compounds having the general formula (B-1):

benzoic acid phenylester,
benzoic acid-4-methylphenylester,
benzoic acid-4-chlorophenylester,
benzoic acid-2,4-dichlorophenylester,
benzoic acid-2,4,6-trichlorophenylester,
benzoic acid-2-methyl-4-chlorophenylester,
benzoic acid-3-bromophenylester,
benzoic acid-2,4-dibromophenylester,
benzoic acid-3-iodophenylester,
benzoic acid-3-nitrophenylester,
benzoic acid-4-methyl-2,6-dichlorophenylester,
benzoic acid-4-isopropylphenylester,
benzoic acid-4-tertiary butylphenylester,
benzoic acid-4-benzylphenylester,
benzoic acid-4-(1'-naphthyl)phenylester,
benzoic acid-2-benzoyloxyphenylester,
benzoic acid-4-(2'-methyl)diphenylester,
benzoic acid-2-phenylethyl oxyphenylester,
benzoic acid-2-acetoxyphenylester,
benzoic acid-4-methoxyphenylester,
benzoic acid-4-(4'-methyl)phenoxyphenylester,
4-methylbenzoic acid phenylester,
4-methoxybenzoic acid phenylester,
4-phenoxybenzoic acid phenylester,
4-acetoxybenzoic acid phenylester,
4-methoxybenzoic acid-4-methoxyphenylester,
2-acetoxybenzoic acid phenylester, 2-benzoyloxybenzoic acid phenylester,
2-nitrobenzoic acid-4-methylphenylester,
4-nitrobenzoic acid-4-methylphenylester,
4-benzoyloxy benzophenone,
2-benzoyloxy-4'-methylbenzophenone,
benzoic acid-4-cyanophenylester,
4-methylbenzoic acid-4-cyanophenylester,
3-methylbenzoic acid-4-cyanophenylester,
4-ethylbenzoic acid-4-cyanophenylester,
4-methoxybenzoic acid-4-cyanophenylester,
3-methoxybenzoic acid-4-cyanophenylester, and
2-methoxybenzoic acid-4-cyanophenylester.

And, the following are enumerated as the typical compounds having the general formula (B-2):
4-benzoyloxybenzoic acid methylester,
4-benzoyloxybenzoic acid ethylester,
4-benzoyloxybenzoic acid-n-propylester,
4-benzoyloxybenzoic acid benzylester,
4-benzoyloxybenzoic acid phenylester,
2-benzoyloxybenzoic acid phenylester,
4-[4'-methylbenzoyloxy]benzoic acid ethylester,
4-[4'-methoxybenzoyloxy]benzoic acid ethylester, and
4-[4'-chlorobenzoyloxy]benzoic acid ethylester.

As the leuco-dye and binder there may be used any one of those having been employed up to now. The typical concrete examples will be cited as follows.

(1) Leuco-dyes:

(a) Triphenylmethane dyes having the following general formula:

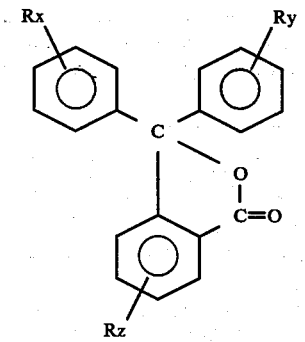

(wherein Rx, Ry and Rz each represents hydrogen, hydroxyl, halogen, alkyl, nitro, amino, dialkylamino, monoalkylamino or allyl.).

In the concrete, the above mentioned compounds are enumerated as follows:
3,3-bis(p-dimethylaminophenyl)phthalide,
3,3-bis(p-dimethylaminophenyl)-6-dimethylaminophthalide (another name: Crystal Violet Lactone),
3,3-bis(p-dimethylaminophenyl)-6-diethylaminophthalide,
3,3-bis(p-dimethylaminophenyl)-6-chlorophthalide, and
3,3-bis(p-dibutylaminophenyl)phthalide.

(b) Fluoran dyes having the following general formula:

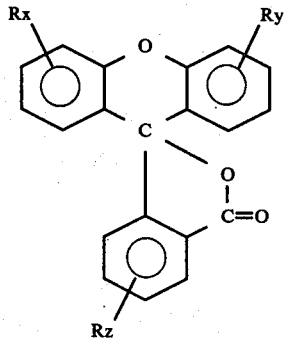

(wherein Rx, Ry and Rz are the same as defined in the preceding (a).)

In the concrete, the above mentioned compounds are enumerated as follows:
3-dimethylamino-5,7-dimethylfluoran,
3-diethylamino-7-methylfluoran, and
3-diethylamino-6-methyl-7-chlorofluoran.

(c) Fluoran dyes:
3-cyclohexylamino-6-chlorofluoran,
3-(N,N-diethylamino)-5-methyl-7-(N,N-dibenzylamino) fluoran,
3-pyrolidino-6-methyl-7-anilinofluoran,
2-{N-(3'-trifluoromethylphenyl)amino}-6-diethylaminofluoran, and
2-{3,6-bis(diethylamino)-9-(0-chloroanilino)xanthyl benzoic acid lactam}.

(d) Lactone compounds having the following general formula:

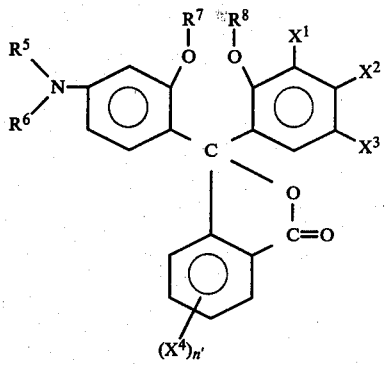

(wherein $R^5$ and $R^6$ each represents hydrogen, lower alkyl, substituted or unsubstituted aralkyl, substituted or unsubstituted phenyl, cyanoethyl, or β-halogenated ethyl, or $R^5$ and $R^6$, taken together, represent $—CH_{2—4}$, $—CH_{2—5}$, or $—CH_{2—2}O—CH_{2—2}$, $R^7$ and $R^8$ each represents hydrogen, lower alkyl, aralkyl, amyl or phenyl, either of $R^7$ and $R^8$ represents hydrogen, $X^1$, $X^2$ and $X^3$ each represents hydrogen, lower alkyl, lower alkoxy, halogen, halogenated methyl, nitro, amino or substituted amino, $X^4$ represents hydrogen, halogen, lower alkyl or lower alkoxy, and n' represents an integer ranging from 1 to 4.).

In the concrete, the above mentioned compounds are enumerated as follows:
3-(2'-hydroxy-4'-dimethylaminophenyl)-3-(2'-methoxy-5'-chlorophenyl)phthalide,
3-(2'-hydroxy-4'-dimethylaminophenyl)-3-(2'-methoxy-5'-nitrophenyl)phthalide, 3-(2'-hydroxy-4'-diethylaminophenyl)-3-(2'-methoxy-5'-methylphenyl)phthalide, and 3-(2'-methoxy-4'-dimethylaminophenyl)-3-(2'-hydroxy-4'-chloro-5'-methylphenyl)phthalide.

(2) Binders

As typical binders suitably used herein there may be enumerated water soluble ones such as polyvinyl alcohol, methoxycellulose, hydroxyethylcellulose, carboxymethylcellulose, polyvinyl pyrrolidone, polyacrylamide, polyacrylic acid, starch, gelatin and the like, or aqueous emulsion type ones such as polystyrene, vinyl chloride-vinyl acetate copolymer, polybutylmethacrylate and the like.

The thermosensitive recording material according to the present invention can more improve the clearness of developed color by further adding a proper quantity (about 5 to 50% by weight) of fine powdered calcium carbonate, silica, alumina, magnesia, talc, barium sulfate, aluminum stearate or the like in the thermosensitive color forming layer, and can more improve the slidability of the thermal head by further adding a proper quantity (about 3 to 30% by weight) of a lubricant such as linseed oil, tung oil, wax, paraffin, polyethylene wax, paraffin chloride or the like in the said layer. In this connection, it is to be noted that the object of the present invention of course can be achieved satisfactorily even when their addition is omitted.

A number of compounds enumerated above are all readily available commercially, and may be manufactured by synthesis.

The thermosensitive recording material according to the present invention may actually be prepared by providing, on the substrate, the thermosensitive color forming layer which comprises dispersing, in the binder, the above mentioned leuco-dye and compounds represented by the general formulas Group (A) and Group (B) as principal components. In this instance, the quantity of the compound (developer) represented by the general formula Group (A) used is preferably in the range of 1 to 5 parts by weight per part by weight of the leuco-dye contained in the thermosensitive color forming layer. In case said quantity is less than 1 part by weight the developed color image with satisfactory density is not obtainable, while in case the quantity is more than 5 parts by weight there is no possibility that the effects are increased that much. On the other hand, the quantity of the compound (thermosensitivity promoter) represented by the general formula Group (B) used is preferably in the range of 0.5 to 4 parts by weight per part by weight of the leuco-dye contained in the thermosensitive color forming layer. In case said quantity is less than 0.5 the thermosensitivity is not enhanced satisfactorily, while in case the quantity is more than 4 parts by weight there is no possibility that the effects are increased that much.

Further, the quantity of the leuco-dye contained in the thermosensitive color forming layer, which is needless to define so strictly but varies somewhat depending on the quantity of binder used, is preferably in the range of about 5 to 20% by weight of the overall thermosensitive color forming layer. Still further, it is preferable that the quantity of said binder should be in the range of about 10 to 40% by weight of the thermosensitive color forming layer. The thickness of the thermosensitive color forming layer (the quantity of solid adhered) is preferable to be in the range of about 5 to 10 $g/m^2$.

The preparation of the thermosensitive recording material according to the present invention is effected in the usual manner of making a thermosensitive color forming layer-forming solution and applying this solution on the substrate (paper, plastic film, synthetic paper, cloth or the like) and drying. As stated previously, the leuco-dyes, compounds having the general formula Group (A), compounds having the general formula Group (B) and binders may each be used singly or in concurrent use of two kinds or more.

The thus prepared thermosensitive recording material of the present invention was observed to have various superior characteristics that due to its markedly high thermosensitivity a clear-cut and high density developed color image can be obtained using a small quantity of heat energy, and besides it can prevent adhesion of dregs to the thermosensitive head to thereby exhibit superior slidability capable of enduring long-run print recording. Further, the thermosensitive recording material of the present invention was observed to be completely freed from fogging during long period of storage and capable of enduring long period of use.

Generally speaking, as the properties or conditions for the thermosensitive recording material to obtain a clear-cut high density image using a small quantity of heat energy there can be enumerated: (i) the leuco-dye and/or developer (color forming agent) per se have a low melting point, (ii) the thermosensitivity promoter exerts a significant influence upon a drop in melting point of the leuco-dye and/or developer, (iii) both the developer and thermosensitivity promoter exhibit a superior mutual solubility against the leuco-dye, (iv) the thermosensitive color forming layer is low in viscosity when subjected to heat melting operation, and (v) the thermosensitive color forming layer per se is insoluble in water, is superior in thermal stability and further is superior in smoothness. Among them, the preceding (ii) and (iii) are considered to exert a significant influence upon accomplishment of high speed recording.

The use of the thermosensitive recording material according to the present invention permits to attain the above mentioned good results. However, the detailed reason why such results are produced thereby is not clarified yet. At any rate, it may be conjectured that the compounds belonging to Group (A) and Group (B) represented by the above mentioned general formulas of the present invention have satisfactorily met the above properties or conditions (i), (ii), (iii), (iv) and (v), and further mutual combinations between these compounds represented by Group (A) and Group (B) have contributed to produce such good results.

Further, the thermosensitive recording material according to the present invention was observed to prevent adhesion of dregs to the thermosensitive head with effect. This is considered to have been achieved due to the fact that both the compounds belonging to Group (A) and those belonging to Group (B) represented by the aforesaid general formulas are thermally stable and low in viscosity when subjected to heat melting operation, and the thermosensitive color forming layer is superior in surface property when subjected to heat print recording.

Still further, the thermosensitive recording material according to the present invention is considered to have produced a high density developed color image using a small quantity of heat energy because a superior mutual solubility exists between the compounds represented by the general formulas Group (A) and those represented by the general formulas Group (B) and consequently the efficiency to the thermosensitive color forming principal component (leuco-dye) increases at a geometrical ratio, thereby enhancing the thermosensitivity markedly.

EXAMPLES

Every part appearing hereinafter is part by weight.

EXAMPLE 1

The following compositions were each mixed and dispersed for 10 hours by means of a ball mill to thereby obtain Dispersion A and Dispersion B. Thereafter, Dispersion A and Dispersion B were mixed together to obtain a solution for use in the formation of a thermosensitive color forming layer.

| | |
|---|---|
| (Composition of Dispersion A) | |
| 3-(N—methyl-N—cyclohexyl)amino-6-methyl-7-anilinofluoran | 5.7 parts |
| 10% aqueous polyvinyl alcohol solution | 20.0 parts |
| Water | 24.3 parts |
| (Composition of Dispersion B) | |
| 4-hydroxybenzoic acid(4-butylphenyl)ester | 16.0 parts |
| 4-methoxybenzoic acid phenylester | 11.0 parts |
| Hydroxyethyl cellulose | 4.0 parts |
| Calcium carbonate | 3.0 parts |
| Water | 16.0 parts |

The thus prepared thermosensitive color forming layer-forming solution was applied on the surface of a high quality paper (50 g/m$^2$) by means of a wire bar and dried to thereby form a thermosensitive color forming layer whose quantity of solids adhered was about 6.3 g/m$^2$. Thus, a thermosensitive recording material (article of the present invention) was obtained.

The thus prepared recording material was printed by means of a thermal printer housing a thermal head therein (under the conditions: 95° C., 14 volts and 1.56 m sec) to obtain a clear-cut black image.

For comparison's sake, a control thermosensitive recording material was prepared in accordance with the exactly same procedure except that the 4-hydroxybenzoic acid(4-butylphenyl)-ester and 4-methoxybenzoic phenylester were removed. This control thermosensitive recording material and that of the present invention were measured with reference to color forming ability at printing temperatures shown in Table-1 (the other conditions are 14 volts and 1.56 m sec). The obtained results are as shown in Table-1.

TABLE 1

| | Our invention material | Control material |
|---|---|---|
| 75° C. | 0.25 | 0.13 |
| 80° C. | 0.84 | 0.37 |
| 85° C. | 1.05 | 0.49 |
| 90° C. | 1.17 | 0.75 |
| 95° C. | 1.20 | 0.85 |
| 100° C. | 1.24 | 0.90 |
| 105° C. | 1.26 | 0.92 |
| 110° C. | 1.27 | 0.94 |

(Note)
The numerical values in the table each denotes a developed color image density. This density was evaluated by measuring the reflection density of each recording material using a Macbeth densitometer.

It was clearly confirmed from the results in Table-1 that the recording material of the present invention could produce a developed color image having a satisfactorily high density using a very small quantity of heat energy at a low temperature, while the control recording material produced a developed color image having an extremely deteriorated density.

Further, both recording materials were subjected to long-run print recording to find that the recording material of the present invention was completely freed from the occurrence of tacky dregs at the thermal head and sticking phenomenon and was extremely good in the slidability of the thermal head, while in the control recording material, tarry dregs adhered to the thermal head and the slidability of the thermal head was thereby deteriorated.

EXAMPLES 2 and 5

Four kinds of thermosensitive recording materials were prepared by repeating the exactly same procedure of Example 1 except that (2) 4-hydroxybenzoic acid(2-methoxyphenyl)ester, (3) salicylic acid(4-benzoylphenyl)ester, (4) benzoic acid-3-methyl-4-hydroxyphenylester and (5) 4-hydroxybenzoic acid benzylester were employed in place of the 4-hydroxybenzoic acid(4-butylphenyl)ester. Each of these thermosensitive recording materials was printed according to the same procedure as Example 1 to show the following highly heat-sensitive results that a clear-cut black image was obtained speedily and a satisfactorily high density developed color image was obtained using a very small quantity of heat energy at low temperature as the recording material in Example 1 of the present invention did. Those thermosensitive recording materials, further, could achieve the same superior results in the slidability against the thermal head and printing aptitudes as the recording material in Example 1 off the present invention did.

EXAMPLES 6 to 11

Six kinds of thermosensitive recording materials were prepared by repeating the exactly same procedure of Example 1 except that (6) benzoic acid phenylester, (7) benzoic acid-4-benzylphenylester, (8) benzoic acid-4-cyanophenylester, (9) 3-methylbenzoic acid-4-cyanophenylester, (10) 4-benzoyloxybenzoic acid ethylester and (11) 4-benzoyloxybenzoic acid phenylester were employed in place of the 4-methoxybenzoic acid phenylester. Each of these thermosensitive recording materials was printed according to the same procedure as Example 1 to show the following highly heat-sensitive results that a clear-cut black image was obtained speedily and a satisfactorily high density developed color image was obtained using a very small quantity of heat energy at low temperature as the recording material in Example 1 of the present invention did. These thermosensitive recording materials, further, could achieve the same superior results in the slidability against the thermal head and printing aptitudes as the recording material in Example 1 of the present invention did.

We claim:

1. A thermosensitive recording material comprising a substrate, a thermosensitive color-forming layer on said substrate, said thermosensitive color forming layer consisting essentially of a colorless or light-colored leuco-dye, at least one kind of developer selected from the group consisting of compounds represented by the following general formulas (A-1), (A-2) and (A-3), at least one kind of thermosensitivity promoter selected from the group consisting of compounds represented by the following general formulas (B-1; L) and (B-2), and a binder:

General formula (A-1)

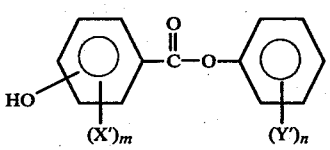

wherein X' represents halogen, nitro or hydrogen, Y' represents hydrogen, lower alkyl, lower alkoxy, halogen, hydroxyl, benzyl, benzoyl, carboxyl, phenoxy, acetyl, allyl or nitro, and m and n each is an integer of 0, 1, 2 or 3, General formula (A-2)

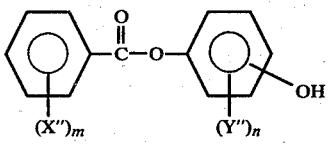

wherein X'' represents hydrogen, nitro or hydroxyl, Y'' represents hydrogen, lower alkyl, lower alkoxy, halogen, nitro or hydroxyl, and m and n each is an integer of 0, 1, 2 or 3, General formula (A-3)

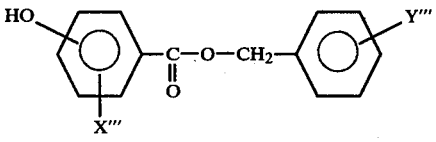

wherein X''' represents hydrogen, methyl, nitro or halogen, Y''' represents hydrogen, methyl, nitro, hydroxyl or halogen, General formula (B-1)

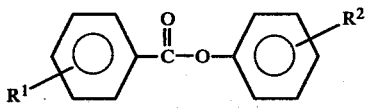

wherein $R^1$ represents hydrogen, alkyl, alkoxy, halogen, nitro, cyano, acetoxy, substituted or unsubstituted benzoyloxy, substituted or unsubstituted benzoxy, substituted or unsubstituted aralkyl or substituted or unsubstituted aralkyloxy, and $R^2$ represents hydrogen, alkyl, alkoxy, halogen, nitro, cyano, acetoxy, substituted or unsubstituted benzoyloxy, substituted or unsubstituted benzoxy, substituted or unsubstituted aralkyl, substituted or unsubstituted aralkyloxy, formyl, arylketone or aryl, and General formula (B-2)

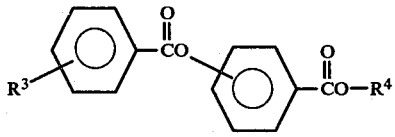

wherein $R^3$ represents hydrogen, alkyl, alkoxy or halogen, and $R^4$ represents alkyl, substituted or unsubstituted aralkyl, or substituted or unsubstituted phenyl.

2. A recording material as claimed in claim 1 wherein said substrate is paper, plastic film, synthetic paper or cloth.

3. A recording material as claimed in claim 1 wherein the developer having the general formulas (A-1) (A-2) and (A-3) is contained in the thermosensitive color forming layer in a quantity ranging from 1 to 5 parts by weight per part by weight of the leuco-dye, the thermosensitivity promoter having the general formulas (B-1) and (b-2) is contained in the thermosensitive color forming layer in a quantity ranging from 0.4 to 4 parts by weight per part by weight of the leuco-dye, and the leuco-dye is contained in the thermosensitive color forming layer in a quantity ranging from 5 to 20% by weight.

* * * * *

UNITED STATES PATENT AND TRADEMARK OFFICE

CERTIFICATE OF CORRECTION

PATENT NO. : 4,444,844

DATED : April 24, 1984

INVENTOR(S) : Keishi Kubo et al

It is certified that error appears in the above-identified patent and that said Letters Patent is hereby corrected as shown below:

Column 10, Line 67; change "(B-1; L)" to ---(B-1)---.

Column 12, line 37; change "(b-2)" to ---(B-2)---.

Signed and Sealed this

*Thirtieth* Day of *October 1984*

[SEAL]

*Attest:*

GERALD J. MOSSINGHOFF

*Attesting Officer*

*Commissioner of Patents and Trademarks*